United States Patent [19]

Zurek et al.

[11] Patent Number: 4,956,867

[45] Date of Patent: Sep. 11, 1990

[54] ADAPTIVE BEAMFORMING FOR NOISE REDUCTION

[75] Inventors: Patrick M. Zurek, Arlington, Mass.; Julie E. Greenberg, Farmington Hills, Mich.; Patrick M. Peterson, Cambridge, Mass.

[73] Assignee: Massachusetts Institute of Technology, Cambridge, Mass.

[21] Appl. No.: 341,139

[22] Filed: Apr. 20, 1989

[51] Int. Cl.[5] ..... H04R 3/00

[52] U.S. Cl. ..... 381/94.1

[58] Field of Search ..... 381/94, 46, 47; 367/123; 379/202, 206; 342/162

[56] References Cited

U.S. PATENT DOCUMENTS

| | | | |
|---|---|---|---|
| 3,057,960 | 10/1962 | Kaiser . | |
| 3,109,066 | 10/1963 | David, Jr. . | |
| 3,882,498 | 5/1975 | McGuffin | 343/7 |
| 4,079,380 | 3/1978 | Esry et al. | 343/100 |
| 4,214,244 | 7/1980 | McKay et al. | 343/18 |
| 4,286,268 | 8/1981 | Daniel et al. | 343/100 |
| 4,548,082 | 10/1985 | Engebretson et al. | 73/585 |
| 4,641,259 | 2/1987 | Shan et al. | 364/724 |
| 4,651,155 | 3/1987 | Baurle et al. | 342/378 |
| 4,686,532 | 8/1987 | McAulay | 342/195 |
| 4,688,187 | 8/1987 | McWhirter | 364/825 |
| 4,713,668 | 12/1987 | Overbury et al. | 342/384 |
| 4,723,294 | 2/1988 | Taguchi | 381/94 |
| 4,752,969 | 6/1988 | Rilling | 455/278 |
| 4,754,282 | 6/1988 | Edelblute et al. | 342/417 |
| 4,758,999 | 7/1988 | Marwood et al. | 367/121 |
| 4,769,847 | 9/1988 | Taguchi | 381/94 |
| 4,771,289 | 9/1988 | Masak | 342/383 |
| 4,806,939 | 2/1989 | Ward et al. | 342/378 |
| 4,811,404 | 3/1989 | Vilmur et al. | 381/94 |

FOREIGN PATENT DOCUMENTS

86/01057 2/1986 PCT Int'l Appl. .

OTHER PUBLICATIONS

"An Alternative Approach to Linearly . . . ", Griffiths et al., *IEEE Transactions on Antennas . . . ,* vol. AP-30, No. 1, 1/82, pp. 27-34.

"Multimicrophone Adaptive Beamforming . . . ", Peterson et al., Submitted to the Journal of Rehabilitation Rsrch and Devel., 11/86.

"Multimicrophone Monaural Hearing Aids," Durlach et al., *RESNA 10th Annual Conference,* San Jose, CA, 1987.

"Using Linearly-Constrained Adaptive . . . ", P. M. Peterson, *Proceedings of ICASSP, Int'l Conf on . . . ,* 4/6-9/87, pp. 2364-2367.

*Primary Examiner*—Forester W. Isen

*Attorney, Agent, or Firm*—Thomas J. Engellenner; David J. Powsner

[57] ABSTRACT

The invention provides an adaptive noise cancelling apparatus which operates to overcome a problem encountered in conventional noise cancelling circuitry when the signal-to-noise ratio at the sensor array is high—to wit, that the target signal is degraded, leading to poorer intelligibility. An apparatus constructed in accord with the invention selectively inhibits the adaptive filter from changing its filter values in these instances and, thereby, prevents it from generating a noise-approximating signal that will degrade the target component of the output signal.

20 Claims, 3 Drawing Sheets

ADAPTIVE BEAMFORMING FOR NOISE REDUCTION

The United States Government has rights in this invention pursuant to Grant No. 5 R01 NS21322-04, sponsored by the National Institute of Health.

BACKGROUND OF THE INVENTION

This invention relates to adaptive signal processing and, more particularly, to adaptive noise cancelling apparatus. The invention has application in systems where it is desired to reduce interference from noise sources that are spatially separate from a target source, e.g., in hearing aids, automatic speech recognition systems, telephony and microphone systems.

Adaptive signal processing systems are characterized by the capability to adjust their response in the face of changing, or time-variant, inputs. These systems are well suited to perform filtering tasks based on automatic "training" in which they continuously monitor their own previously-generated output signals to replace or remove specified components in presently-received input signals. While adaptive systems have broad applicability in areas such as prediction, modeling and equalization, of particular interest here is their application in interference cancelling, i.e., the removal of unwanted noise from input signals.

The prior art offers a variety of noise cancelling circuits. Among these are adaptive beamforming systems, which use spaced arrays of sensors, e.g., microphones, to reduce interference. A simple system, known as the Howells-Appelbaum sidelobe cancler, for example, employs two omnidirectional sensors for receiving input signals generated by target and interference sources. The system filters one of the input signals, the "reference," through an adaptive element and subtracts it from the other, the "primary." The output signal resulting from this subtraction is fed back to the adaptive element which adjusts the filter to minimize the difference between the filtered reference and primary signals. As the filter converges, the signal-to-noise ratio of the output improves—at least when interference dominates the input. See, for example, Widrow et al, *Adaptive Signal Processing,* Prentice Hall (1985), at pp. 302, et seq.

More complex beamforming systems proposed by Frost, and by Griffiths and Jim, among others, provide improved output signal-to-noise ratios under conditions where the input noise component is not dominant. See, Widrow et al, supra, and Griffiths, et al, "An Alternative Approach to Linearly Constrained Adaptive Beamforming," IEEE Transactions on Antennas and Propagation, vol. AP-30 (January 1982), at pp. 27, et seq.

Unfortunately, even these systems lose their effectiveness when the input becomes dominated by the target itself, or when a target-free sample of noise is not available. Here, the prior art adaptive systems degrade the target signal, producing an output with a lower signal-to-noise ratio than the input. This deficiency becomes of real concern where such beamforming circuits are incorporated into hearing aids and other applications where a target-free reference signal is unavailable and the system must operate at high, as well as low, signal-to-noise ratios.

In view of the foregoing, an object of this invention is to provide an improved adaptive beamforming system.

More particularly, an object of this invention is to provide an adaptive beamforming system which operates effectively over all ranges of input signal-to-noise ratios.

A further object of this invention is to provide an improved hearing aid which processes incoming signals using adaptive beamforming techniques and which continues to operate effectively even when there is relatively little interference in the input signals.

SUMMARY OF THE INVENTION

The aforementioned objects are attained by the invention, which provides, in one aspect, an adaptive noise cancelling apparatus which operates to overcome the problem encountered in conventional noise cancelling circuitry when the signal-to-noise ratio at the sensor array is high—to wit, that the target signal is degraded, leading to poorer intelligibility. In these instances, rather than allowing the adaptive filter to converge on filter values that degrade the target component of the output signal, a system constructed in accord with invention selectively inhibits adaptation, thereby preserving the target signal. To do this, the system takes advantage of momentary low signal-to-noise ratios, which are characteristic of human speech, for example, to converge to a desired filter response.

In another aspect, the invention provides an adaptive noise cancelling apparatus including an array of spatially disposed sensors, each arranged to receive an input signal having target and noise signal components, and an element coupled to the array for combining one or more of those input signals to form a primary signal. Another generator element is also coupled to the array to process the input signals to generate one or more reference signals representing only noise components of the input signals.

An adaptive filter produces a noise-approximating signal as a function of reference signals received over time and feeds that noise-approximating signal to an output element, which subtracts it from the primary to produce an output approximating the target signal.

A feedback path, including an adaptation controller, is coupled between the output elemebnt and the adaptive filter. The controller generates an adaptation signal as a function of the output signal and an SNR signal, which the controller generates from the input signals. More particularly, the controller is coupled with the sensor array for processing one or more of the input signals to generate the SNR signal as representative of the relative strength, over a short time, of the target signal to the noise signal. In one aspect, this SNR signal represents a cross-correlation between input signals received by two or more of the sensors.

The adaptative filter is coupled with the adaptation controller to receive the adaptation signal and to selectively modify the noise-approximating signal to minimize a difference between it and the primary signal. By providing that modified noise-approximating signal to the output element, the latter is able to generate an output signal more closely matching the target signal.

In one embodiment, the invention can provide an adaptive noise canceler of the type described above in which the adaptation controller includes a threshold detection element which generates a zero-valued adaptation signal if the SNR signal is in a first selected range, and for generating an adaptation signal which is equivalent to the output signal if the SNR signal is in a second selected range. In another embodiment, the adaptation controller can include a sliding scale element which generates an adaptation signal that varies with the SNR signal.

The adaptive noise cancelers of the present invention can further include filters within the adaptation controller for providing selected linear filterings of at least certain ones of the received input signals. According to another aspect of the invention, those filterings can be selected in accord with a range of expected delays in noise signal components received by selected ones of said sensor elements.

These and other aspects of the invention are evident in the drawings and in the detailed description which follows.

DETAILED DESCRIPTION OF THE ILLUSTRATED EMBODIMENT

Figure 1:
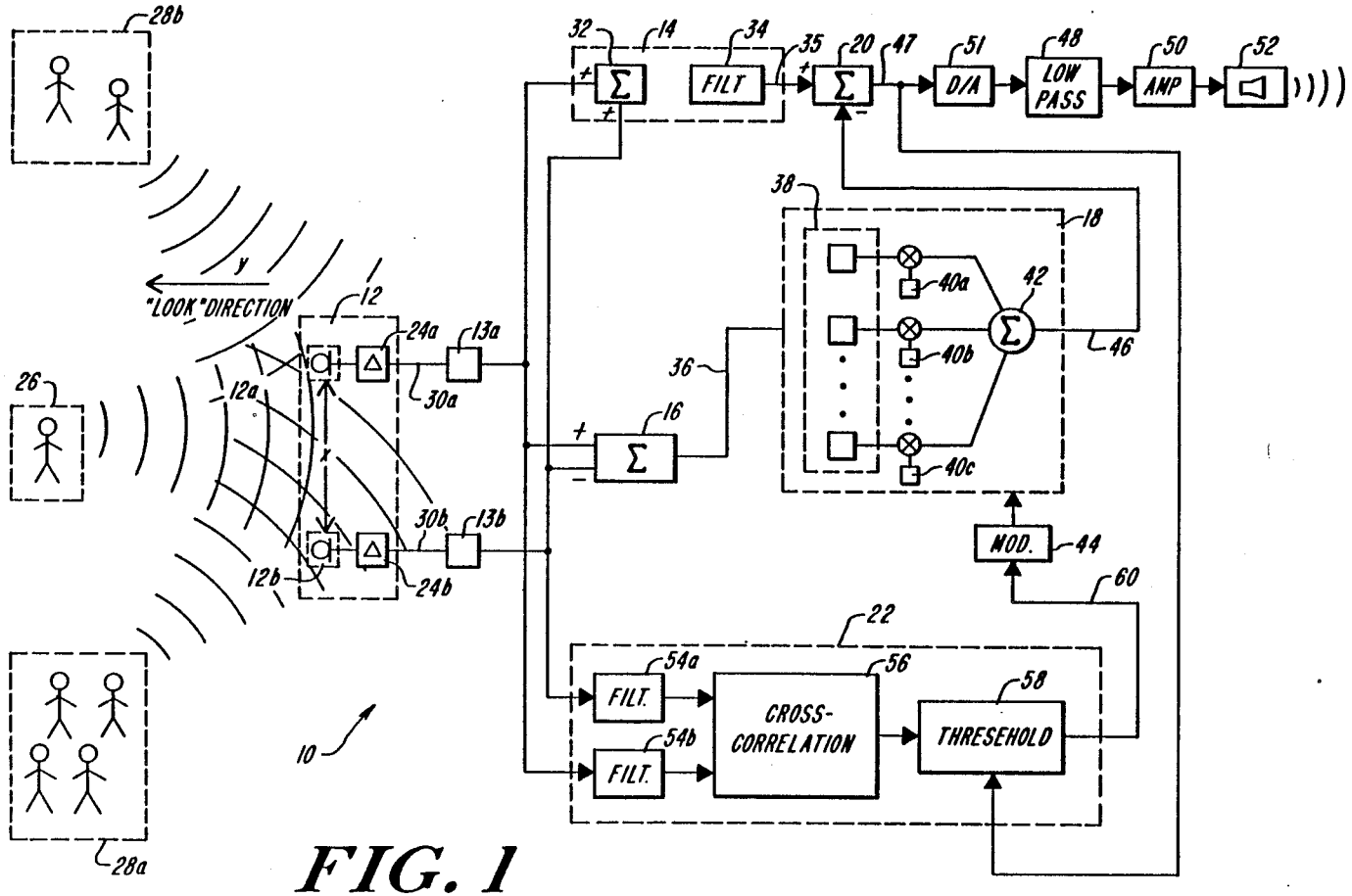
FIG. 1 depicts a two-microphone adaptive noise cancelling system constructed in accord with the invention.

FIG. 1 depicts a two-microphone adaptive noise cancelling system 10 constructed in accord with the invention. The illustrated system 10 includes a receiving array 12, sampling elements 13*a*, 13*b*, a primary signal generator 14, a reference signal generator 16, an adaptive filter 18, an output element 20, and an adaptation controller 22.

Receiving array 12 includes two sensors, e.g., microphones, 12*a*, 12*b*, spaced apart by a distance x and arranged to receive input signals having signal components from a target source 26 and noise sources 28*a*, 28*b*. In the illustrated embodiment, delays 24*a*, 24*b* are connected with the sensors 12*a*, 12*b* to steer the array 12, i.e., to delay input signals differentially to insure that target signal components received in the "look" direction y are in phase.

Sampling elements 13*a*, 13*b* sample the input-representative signals generated by array 12 and pass the sampled inputs on to other elements of the illustrated system. The sampling elements 13*a*, 13*b* are discussed in further detail below.

Primary signal generator 14 receives input signals from the sampling elements 13*a*, 13*b* over conductor lines 30*a*, 30*b* and generates a primary signal representative of a selected combination of those input signals. In a preferred embodiment, generator 14 comprises a summation element 32 for adding the input signals, as well as a filter element 34, which may include a delay to simulate non-causal impulse responses of the adaptive filter. The primary signal is transmitted from the generator 14 to the output element over conductor line 35.

The reference signal generator 16 also receives input signals from the samplers 13*a*, 13*b* over conductor lines 30*a*, 30*b* to produce a reference signal representing components of the noise signal. The illustrated generator 16 produces that reference signal by subtracting input signals received by one sensor 12*b* from those received by the other 12*a*. Output from the reference signal generator 16 is transmitted to the adaptive filter 18 over conductor line 36, as indicated in the drawing.

The adaptive filter 18 generates a signal which approxmates the value of the noise signal. This approximation is based on the noise component signals received from the reference signal generator 16 over a selected period of time. For this purpose, the illustrated filter 18 includes a tapped delay line 38 having a plurality of "taps," or stores, which retain values of reference signals generated during the past L timing intervals, where L is referred to as the length of the adaptive filter. The tapped delay line 38 also includes a set of weighting elements 40*a*, 40*b*, . . . , 40*c* which store mathematical weights associated with each of the L taps. A linear combiner 42 is coupled to the taps and to the weighting elements for generating the noise-approximating signal as a sum of the multiplicative products of each of the stored reference signals and the associated weights. That noise-approximating signal is transmitted to the output element 20 over line 46.

Output element 20 generates an output signal, representing the signal generated by the target 26, by subtracting the primary signal, received over conductor line 35, from the noise-approximating signal, received over line 46. In a preferred hearing-aid embodiment, that output signal can be passed over line 47 to a digital-to-analog converter, a low-pass filter 48, an amplifier 50, and a speaker 52 to provide an audible signal suitable for the hearing-aid user. The output signal is also routed over line 47 to the adaptation controller 22.

The adaptation controller 22 processes input signals received over lines 30*a*, 30*b* to generate an SNR signal representing a relative strength of the target signal to the noise signal. In the illustrated system, the SNR signal is produced by first passing each of the sampled input signals through fixed linear filters 54*a*, 54*b*, selected according to the range of expected delays in the noise signal components received by the sensors 12*a*, 12*b*.

The outputs of filters 54*a*, 54*b* are then passed to an element 56 which, in accord with a preferred embodiment, generates the SNR signal from a running cross-correlation of the filtered input signals. Through the element 56 can produce the SNR signal by multiplying the values represented by the filtered input signals, preferably, it simply estimates the cross-correlation by multiplying the polarity of those inputs.

In the illustrated embodiment, the SNR sgnal is passed to a threshold detection element 58 which generates an adaptation signal having a value of zero if the SNR signal is in a first selected range and having a value equal to that of the output signal (received over line 47) if the SNR signal is in a second selected range. Where the SNR signal represents an estimate of the input signal cross-correlation—as opposed to another estimate of target signal strength to noise signal strength—a zero-valued adaptation signal is generated in response to a cross-correlation signal having a value above a preselected threshold, and an output signal-equivalent adaptation signal otherwise.

In another preferred embodiment, the adaptation element 22 can include a sliding scale element which generates an adaptation signal having a value which varies, e.g., monotonically, with the SNR signal.

The adaptation signal generated by the adaptation controller 22 is transmitted to modification element 44 over conductor line 60. Element 44 adjusts the weight-representative signals in response to that adaptation signal to minimize a difference between the noise-approximating signal and the primary signal.

A fuller appreciation of the operation of the adaptive noise canceler 10 may be understood as follows. The sensor array 12 receives input signals generated by the target source 26 and the noise source 28. As a result of the positioning of the sensors, and/or the delays effected by the steering elements 24*a*, 24*b*, the array 12 produces input-representative signals having target signal components which are nearly in phase and noise signal components which are substantially out of phase.

Generator 14 combines the input signals to produce a primary signal, having both target and noise components, which is a sum of the input signals. Simultaneously, generator 16 subtracts the input signals from one another to produce a reference signal having predominantly noise components. The reference signal is fed into the adaptive filter 18 which produces a noise-approximating signal based on a weighted sum of current and past values of the reference signal.

Subtracting this noise-approximating signal from the primary signal, output element 20 produces an output signal approximating the target signal.

To improve the quality of the output signal, the adaptive filter 18 continuously monitors the adaptation signal, generated by controller 22, to determine if the weighting values require adjustment. In this regard, it will be appreciated that the power of the output signal falls to a minimum when that signal contains only target signal components.

To prevent degradation of the target signal when it dominates the beamformer input, the illustrated adaptation controller 22 reduces the adaptation signal to zero when it determines that the cross-correlation of the input signal is high. The filter 18 interprets that zero-valued signal as an indication that the input target-to-noise ratio is high and, accordingly, freezes the current weight values. Where, on the other hand, the cross-correlation is low, the controller 22 generates an adaptation signal equal in value to the output signal, so that the filter 18 can further adjust the weights, if necessary, to minimize the power output.

In this light, it is clear that the filters 54*a*, 54*b* function to pass those frequencies of the input signals which are most likely to indicate the presence of noise, i.e., those which will experience the greatest decorrelation given the particular spacing of the sensors 12*a*, 12*b*.

A further understanding of the operation of a preferred embodiment of the beamforming system 10 may be attained by reference to FIG. 2 and to the chart below, which together present in mathematical from the values of signals generated by the system components. The circuit of FIG. 2 is similar to that of FIG. 1 and, accordingly, uses like element designations.

Figure 2:
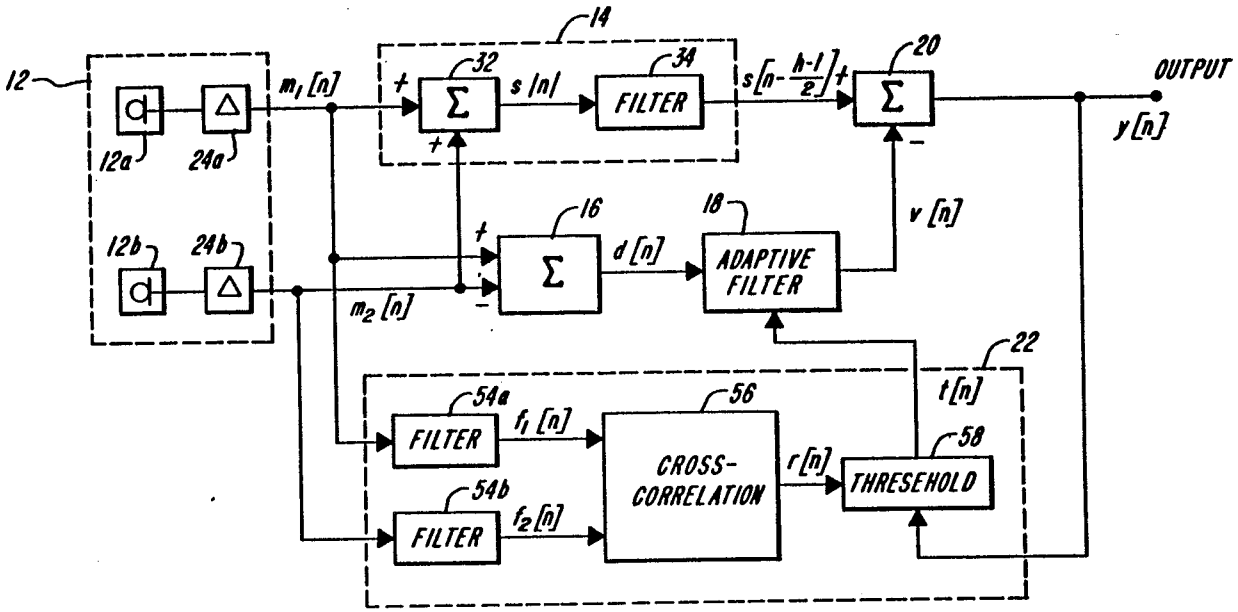
FIG. 2 depicts a two-microphone adaptive noise cancelling system constructed in accord with a preferred embodiment of the invention indicating relationships between signals generated by system components.

In FIG. 2, the value of signals transmitted between components are denoted adjacent the conductor lines connecting those components. A more complete expression of those values is given in Table 1, below. Thus, for example, input signals passed from the sensor array 12 to the primary signal generator 14 and the reference signal generator 16 are denoted $m_1[n]$ and $m_2[n]$. Upon processing by summation element 32 of the primary signal generator 14, the input signals are combined to form the primary signal, s[n], which Table 1 indicates as having a value equal to one-half the sum of the sensor signals, i.e., $(m_1[n][m_2[n])/2$. The remaining signal values shown in the drawing can be interpreted in a like manner.

TABLE 1

| Signal | Value/Description |
|---|---|
| d[n] | $\frac{1}{2} \times (m_1[n] - m_2[n])$ |
| $f_j[n]$ | the sum of $(m_j[n - i] \times g_i)$, for i = to N − 1, and for j = 1, 2 |
| $m_1[n]$ | input-representative signal from sensor 12a |
| $m_2[n]$ | input-representative signal from sensor 12b |
| r[n] | $0.99 \times r[n - 1] + 0.01 \times f[n]$, where $f[n] = +1$, if $f_1[n] \times f_2[n] > 0$, and $f[n] = -1$, if $f_1[n] \times f_2[n] < 0$ |
| v[n] | the sum of $(d[n - k] \times w_k[n])$, for k = 0 to (L − 1) |
| s[n] | $\frac{1}{2} \times (m_1[n] + m_2[n])$ |
| t[n] | 0, if r[n] > threshold constant, and y[n], if r[n] < threshold constant |
| y[n] | s[n − (L − 1)/2] − v[n], for odd values of L |

In Table 1 and FIG. 2, bracket notation is used to denote the value of each signal at specific time intervals. Thus $m_1[n]$, $m_2[n]$ and y[n] represent input and beamformer output sgnal values, respectively, at timing interval n, where n is an integer. It will be noted that the signal output by element 34 also includes a time component; however, unlike that of the other system elements, the element 34 output is delayed (L−1)/2 timing intervals, a time period equal to roughly half the length of the adaptive filter 16. Those skilled in the art will appreciate that such a delay simulates a non-causal impulse response; that is, it permits the adaptive filter 18 to employ values of the reference signal d[n] received both before and after the primary signal.

Consistent with the above notation, the modification element 44 (FIG. 1) adjusts the weights used in the adaptive filter 18 in accord with an unconstrained least squares algorithm and based upon a power value q[n] equal to $0.9941 \times p[n-1] + 0.0059 \times p[n]$, where p[n] is equal to $(y[n])^2 + (d[n])^2$; a weight-delta value D[n] equal to $2 \times A \times (t[n])/(L \times (q[n]))$; and weight update values $W_k[n+1]$ equal to $W_k[n] + (D[n]) \times (d[n-k])$, where $W_k$ represents a weight associated with a kth tap in delay line 38 and where k is an integer between 0 and (L−1).

A preferred beamforming system 10 intended for use in a hearing aid, assuming a sampling frequency of 10 kHz, has an adaptive filter length, L, between 5 and 500 samples, with a preferred value of 169; a correlation filter length, N, between 5 and 500, with a preferred value of 100; an adaptation constant, A, between 0.005 and 0.5, with a preferred value of 0.05; and a threshold constant between −0.5 and +0.5, with a preferred value of 0.0.

In a preferred embodiment, the beamforming system 10 is implemented using two Motorola DSP56000ADS signal processing boards: one for performing the functions of the primary signal generator 14, the reference signal generator 16, the adaptive filter 18 and the output element 20; and the other, for performing the functions of the adaptation element 22.

The aforementioned system 10 employs a digital-to-analog converter 51 interposed between the output element 20 and low-pass filter 48. The system also employs sampling elements 13*a*, 13*b* of the type depicted in FIG. 3 for converting incoming target and noise signals to digital form.

Figure 3:
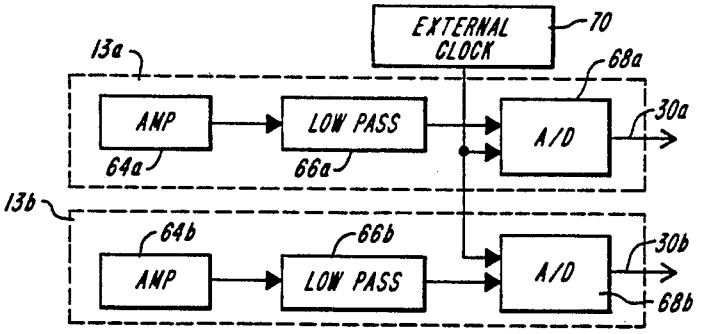
FIG. 3 depicts preferred circuitry for sampling elements used to convert incoming sensor signals to digital form.

Referring to FIG. 3, samplers 13*a*, 13*b* include, respectively, amplifiers 64*a*, 64*b*, low-pass filters 66*a*, 66*b* and analog-to-digital converters 68*a*, 68*b*. Each samplers 13*a*, 13*b* is coupled to a microphone 12*a*, 12*b* (FIG. 1) and preamplifier (not shown) of the array 12

(FIG. 1). Amplified input-representative signals, generated by amplifiers 64a, 64;I b, are filtered through low-pass filters 66a, 66b, selected to pass target and noise signal frequencies less than one-half the sampling frequency.

Filtered input signals from both illustrated channels are sampled by analog-to-digital converters 68a, 68b, which are driven by external clock 70. The digital outputs of the converters 68a, 68b are passed, via lines 30a, 30b, respectively, to the primary signal-generator 14, reference signal-generator 16, and adaptation controller 22 for processing in the manner described above.

In a preferred embodiment intended for use in conjunction with a hearing aid, the low-pass filters 66a, 66b are selected to pass frequencies below 4.5 kHz, and the sampling rate of the A/D converters 68a, 68b is set at 10 kHz.

Figure 4:
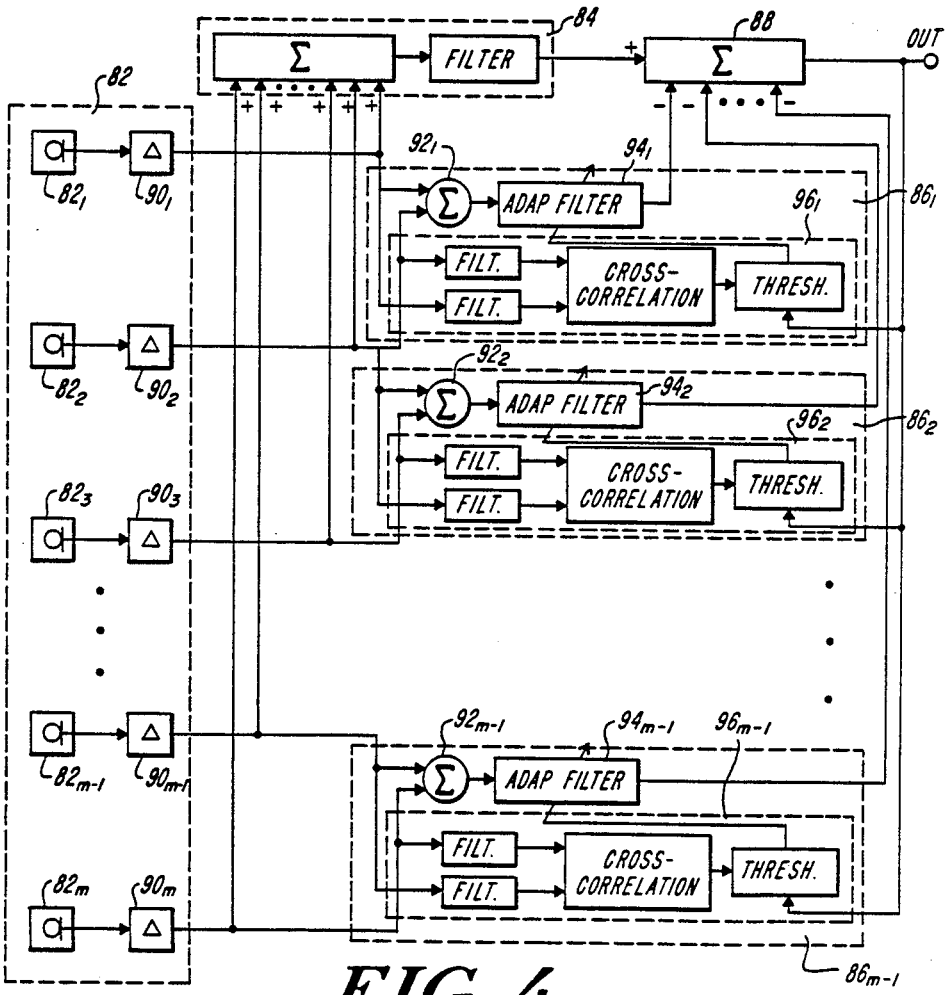
FIG. 4 depicts an M-microphone adaptive noise cancelling system constructed in accord with the invention.

The above teachings can be applied, more generally, to an (M−1) sensor beamforming system constructed and operated in accord with the invention, where M is an integer greater than or equal to two. One such system is depicted in FIG. 4. The illustrated system 80 includes a receiving array 82, a primary signal generator 84, (M−1) beamforming sections $\mathbf{86}_1$, $\mathbf{86}_2$, . . . $\mathbf{86}_{M-1}$, and output element 88. Each beamforming section includes a reference signal generator $\mathbf{92}_1$, $\mathbf{92}_2$, . . . $\mathbf{92}_{M-1}$, an adaptive filter (which can include a modification element, now shown) $\mathbf{94}_1$, $\mathbf{94}_2$, . . . $\mathbf{94}_{M-1}$, and a adaptation controller $\mathbf{96}_1$, $\mathbf{96}_2$, . . . $\mathbf{96}_{M-1}$. These elements are constructed and operated in accord with the teachings of similarly-named elements shown in FIGS. 1 and 2, described above.

Particularly, receiving array 82 includes a plurality of sensors $\mathbf{82}_1$, $\mathbf{82}_2$, . . . $\mathbf{82}_{M-1}$, $\mathbf{82}_M$, each having a corresponding steering delay $\mathbf{90}_1$, $\mathbf{90}_2$, $\mathbf{90}_3$, . . . $\mathbf{90}_{M-1}$, $\mathbf{90}_M$. As illustrated, the outputs of the array 82 are passed to the primary signal generator 84. Likewise, the outputs of pairs of those sensors are passed to the reference signal generators $\mathbf{92}_1$, $\mathbf{92}_2$, . . . $\mathbf{92}_{M-1}$ and to the adaptation controllers $\mathbf{96}_1$, $\mathbf{96}_2$, . . . $\mathbf{96}_{M-1}$.

As above, the reference signal generators and adaptation controllers pass their output—representative, respectively, of reference and adaptation signals corresponding to associated pairs of the sensors—to corresponding adaptive filters (and modification element) $\mathbf{94}_1$, $\mathbf{94}_2$, . . . $\mathbf{94}_{M-1}$. These adaptive filters produce noise-component approximating signals which approximate the noise signal components received from the associated sensor pairs based on a time-wise sample of those components. The output of the filters $\mathbf{94}_1$, $\mathbf{94}_2$, . . . $\mathbf{94}_{M-1}$ are routed to the output element 88, which subtracts them from the primary signal, thereby producing an output signal matching the target signal.

The foregoing describes improved adaptive beamforming systems which can be constructed using a plurality of sensors to reduce interference from noise sources that are spatially separate from a target source. These improved systems operate effectively over all ranges of input signal-to-noise ratios and, unlike prior art systems, do not suffer target signal degradation when input signal-to-noise ratios are high.

Those skilled in the art will appreciate that the illustrated embodiments described above are exemplary only, and that modifications, additions and deletions can made thereto without falling outside the scope or spirit of this invention: for example, that at least portions of the systems described above can be constructed to process analog, as well as digital, signals; that the SNR signals can be generated as a function of the input received from one, as well as many, sensors; that the adaptation controller can employ a combination of threshold and sliding scale elements; and that the adaptive filter can employ any of a number of known weight-modification algorithms, in addition to the unconstrained least squares algorithm.

In view of the foregoing, what we claim is:

1. An adaptive noise cancelling apparatus comprising:

A. a receiving array including a plurality of spatially disposed sensors, each for receiving an input signal, comprising at least one of a component of target signal and a component of a noise signal, and for generating a signal representative of said input signal, B. primary signal means coupled with said receiving array for generating a primary signal representative of a first selected combination of one or more of said input-representative signals, C. reference signal means coupled with said receiving array for producing one or more signals representative of a second selected combination of said input-representative signals, D. adaptive filter means coupled to said reference signal means for generating a noise-approximating signal as a function of one or more noise component-representative signals produced during a selected period of time, E. output means coupled to said primary signal means and to said adaptive filter means for subtracting said noise-approximating signal from said primary signal to generate an output signal representative of said target signal, F. adaptation controlling means coupled with said receiving array for generating an SNR signal representative of a relative strength of said target signal to said noise signal, said adaptation controlling means including means coupled with said output means for generating an adaptation signal as a function of said output signal on said SNR signal, and G. modification means coupled with said adaptation controlling means and with said adaptive filter means for responding to said adaptation signal to selectively modify said noise-approximating signal to minimize a difference between it and one or more selected noise components of said primary signal.

2. An adaptive noise cancelling apparatus according to claim 1, wherein said adaptation controlling means comprises threshold detection means for generating a zero-valued adaptation signal when said SNR signal has a value in a first selected range, and for generating an adaptation signal which is equivalent to said output signal when said SNR signal has a value in the second selected range.

3. An adaptive noise cancelling apparatus according to claim 1, wherein said adaptation controlling means comprises sliding scale means for generating an adaptation signal which varies with said SNR signal.

4. An adaptation noise cancelling apparatus according to claim 1, wherein said adaptation controlling means includes means for generating said SNR signal as representative of a cross-correlation between input signals received by two or more of said sensors.

5. An adaptive noise cancelling apparatus according to claim 4, wherein said adaptation controlling means includes means for detecting the polarity of at least selected ones of said input-representative signals and for generating an estimate of said cross-correlation based upon that polarity.

6. An adaptive noise cancelling apparatus according to claim 4, wherein said adaptation controlling means comprises threshold detection means for generating a zero-valued adaptation signal when said SNR signal is above a selected value, and for generating an adaptation signal equivalent to said output signal when said SNR signal is below said selected value.

7. An adaptive noise cancelling apparatus according to claim 4, wherein said adaptation controlling means comprises sliding scale means for generating an adaptation signal which varies inversely with said SNR signal.

8. An adaptive noise cancelling apparatus according to claim 1, wherein said adaptation controlling means includes fixed linear filtering means coupled with selected ones of said sensors for generating a signal representative of a selected linear filtering of the input-representative signals generated thereby.

9. An adaptive noise cancelling apparatus according to claim 8, wherein said selected linear filtering is selected in accord with a range of expected delays in noise signal components received by selected ones of said sensor elements.

10. An adaptive noise cancelling apparatus according to claim 1, wherein said adaptive filter means includes a tapped delay line associated with selected combinations of one or more sensors, said tapped delay line including one or more tap means for storing signals, representative of selected ones of said noise component-representative signals generated over a plurality of timing intervals.

11. An adaptive noise cancelling apparatus according to claim 10, wherein said adaptive filler means includes weighting means for storing signals representative of a weight associated with one or more of said tap means.

12. An adaptive noise cancelling apparatus according to claim 11, wherein said adaptive filter means includes linear combiner means coupled to said tapped delay line means and said weighting means for generating a noise component-approximating signal representative of a sum of multiplicative products of each said weight-representative signal and its associated noise-component representative signal.

13. An adaptive noise cancelling apparatus according to claim 12, wherein said adaptive filter means includes means coupled to one or more of said linear combiner means for generating said noise-approximating signal as a sum of one or more said noise component-approximating signals.

14. An adaptive noise cancelling apparatus according to claim 13, wherein said adaptive filter means includes means for selectively modifying said weight-representative signals in accord with an unconstrained least-squares algorithm.

15. An adaptive noise cancelling apparatus according to claim 1, wherein said primary signal means includes means for generating said primary signal as representative of a selected linear combination of at least selected ones of said input-representative signals.

16. An adaptive noise cancelling apparatus according to claim 15, wherein said primary signal means further includes means for generating a signal representative of a selected linear filtering of said selected linear combination-representative signal.

17. An adaptive noise cancelling apparatus according to claim 16, wherein said selected linear filtering includes a delay.

18. An adaptive noise cancelling apparatus according to claim 1, wherein said receiving array includes steering delay means coupled to said sensors for permitting selective delay of generation of said input-representative signals.

19. An adaptive noise cancelling apparatus according to claim 1, wherein said receiving array means includes means for generating a sampled input-representative signal in digital form.

20. An adaptive noise cancelling apparatus according to claim 1, wherein said primary signal means includes means for generating said primary signal as equivalent to an input signal received at a single said sensor.

* * * * *